US007095863B2

(12) United States Patent
Heron et al.

(10) Patent No.: US 7,095,863 B2
(45) Date of Patent: Aug. 22, 2006

(54) PANEL FORM LOUDSPEAKER

(75) Inventors: Kenneth Harry Heron, Farnborough (GB); Malcolm Nash, Farnborough (GB); Andrew Philip Payne, Farnborough (GB)

(73) Assignee: QinetiQ Limited, Hants (GB)

( * ) Notice: Subject to any disclaimer, the term of this patent is extended or adjusted under 35 U.S.C. 154(b) by 300 days.

(21) Appl. No.: 10/470,972

(22) PCT Filed: Feb. 4, 2002

(86) PCT No.: PCT/GB02/00454

§ 371 (c)(1),
(2), (4) Date: Jul. 31, 2003

(87) PCT Pub. No.: WO02/063919

PCT Pub. Date: Aug. 15, 2002

(65) Prior Publication Data

US 2004/0052386 A1 Mar. 18, 2004

(30) Foreign Application Priority Data

Feb. 6, 2001 (GB) ..... 0102865.3

(51) Int. Cl.
*H04R 25/00* (2006.01)

(52) U.S. Cl. ..... 381/152; 381/182; 381/424; 381/431

(58) Field of Classification Search ..... 381/152, 381/182, 191, 423, 424, 426, 431; 181/163–165
See application file for complete search history.

(56) References Cited

U.S. PATENT DOCUMENTS

| | | | | |
|---|---|---|---|---|
| 3,423,543 | A * | 1/1969 | Kompanek | 381/152 |
| 4,357,498 | A * | 11/1982 | Tsuchiya et al. | 381/424 |
| 4,554,414 | A * | 11/1985 | House | 381/182 |
| 4,847,908 | A * | 7/1989 | Nieuwendijk et al. | 381/424 |
| 6,278,790 | B1 * | 8/2001 | Davis et al. | 310/324 |
| 2001/0009587 | A1 * | 7/2001 | Niederdrank | 381/423 |

FOREIGN PATENT DOCUMENTS

| | | |
|---|---|---|
| DE | 43 43 807 | 6/1995 |
| EP | 0 541 646 | 1/1995 |
| EP | 1 063 866 | 12/2000 |
| WO | WO 96/31086 | 10/1996 |
| WO | WO 97/09842 | 3/1997 |
| WO | WO 98/52381 | 11/1998 |
| WO | WO 00/05920 | 2/2000 |

* cited by examiner

*Primary Examiner*—Suhan Ni
(74) *Attorney, Agent, or Firm*—McDonnell Boehnen Hulbert & Berghoff LLP

(57) ABSTRACT

A panel form loudspeaker comprises a resonant multi-mode radiator (11) which in turn comprises a plurality of substantially concentric sub-panels (20, 21, 22, 23). A plurality of analogue drivers (10) drive the radiator (11), one or more of the drivers being operational at any time. A signal level measured at the input to the loudspeaker determines the operational state of each of the drivers (10). The concentric sub-panels may take various shapes and have different areas.

13 Claims, 6 Drawing Sheets

Type 3 Algorithm, Without Exponential Smoothing

PANEL FORM LOUDSPEAKER

BACKGROUND OF THE INVENTION (1) Field of the Invention

This invention relates to loudspeakers and in particular to a panel form loudspeaker with improved dynamic range as compared to existing loudspeakers.

(2) Description of the Art

Conventional analogue loudspeakers have a limited dynamic range as compared to the available dynamic range of the latest digital recordings (for example 24 bit or DSD). Digital recordings use up to 24 bits and this implies a dynamic range of 141 dB. Digital loudspeakers, involving $2^N$ single bit devices (with N=24, this number is $1.7\times10^7$) have been proposed—see WO96/31086. However, these suffer from obvious complexity and poor performance associated with the interaction effects between the different devices, which have discouraged widespread use of such systems. A further problem is the inability of most loudspeakers to reproduce realistic absolute levels of sound (up to say 120 dB at 1 m without distortion), so such digital loudspeakers cannot take full advantage of the 24-bit fidelity.

FIG. 1 shows a conventional loudspeaker system comprising three drivers/loudspeakers 1, 2, 3. A master signal 4 is split by filters 5, 6 and 7 (high pass filter, band pass filter and low pass filter respectively) into three frequency ranges, treble 5*a* which goes to speaker 1, mid-range 6*a* which goes to speaker 2 and bass 7*a* which goes to speaker 3. This represents a multiple speaker system in which there is a frequency split of the main master drive signal 4. The relationship between each of the drivers 1, 2 and 3 is fixed and is not dependent on the level of the master signal.

A conventional loudspeaker system, such as that shown in FIG. 1, will suffer distortion and other detrimental effects if the dynamic range supplied to any of the drivers/loudspeakers 1, 2 or 3 exceeds much more than 100 dB. Note, although conventional speakers can be constructed to have a dynamic range of approaching 120 dB they are very expensive. More usually the dynamic range of a conventional speaker is in the region of 100 dB.

SUMMARY OF THE INVENTION

It is therefore an object of the present invention to provide a loudspeaker system, which overcomes or at least mitigates the above-mentioned problems with prior art systems.

Accordingly this invention provides a panel form loudspeaker comprising a resonant multi-mode radiator, the radiator having a plurality of substantially concentric sub-panels; and a plurality of analogue drivers to drive the radiator, one or more of the drivers being operational at any time, wherein a signal level measured at the input to the loudspeaker determines the operational state of each of the drivers.

FIG. 1 as described above represents a conventional loudspeaker system. FIG. 2 shows a loudspeaker according to the present invention comprising a number of drivers 10*a*, 10*b*, 10*c*, 10*d* . . . 10*n*, which receive their input from a master signal 8. Note, this master signal could be the same as master signal 4 in FIG. 1 or it could represent one of the channels 5*a*, 6*a* or 7*a* or any other aspect of an audio system.

Each master signal 8, see FIG. 2, is a time varying data steam, and it is this varying amplitude level that determines the signal sent to each driver 10*a* . . . 10*n*.

By choosing suitable factors in the calculation of the drive signals for each driver it is possible to make sure that no driver is overloaded and each will operate within its linear dynamic range with low distortion.

Panel form loudspeaker technology is able to take advantage of digital fidelity because it is able to inherently produce very high absolute levels of sound. The present invention uses a flat panel loudspeaker having multiple radiator sub-panels arranged substantially concentrically to give a natural sound, combined with a plurality of analogue drivers or exciters to overcome the problems of complexity, interaction effects and loudness which limit the benefits of existing solutions. Prior art devices have suggested the use of more than one driver for a single loudspeaker, but none of them have recognised the need to control how these drivers interact to obtain the benefits of the present invention.

Preferably, the sub-panels are coupled together via an acoustically opaque medium in order to reduce the interference between different sub-panels.

The sub-panels may be different sizes and preferably; each additional sub-panel has an area twice that of the preceding sub-panel.

The sub-panels may have one driver each, but preferably each additional sub-panel has a number of drivers twice that of the preceding sub-panel.

There are a number of alternative algorithms by which the analogue drivers can be controlled.

In a first algorithm, an oversampling method is used. The signal to each driver is determined at each digital data point using INT $\{(x+k)/n\}$ for the kth driver, $0 \leqq k < n$, where x is the basic signal level expressed as a signed integer, n is the number of drivers and INT { } implies the lowest integer part of. This algorithm is shown in FIG. 3 for a full level sine wave with 16 drivers. This algorithm is complex, but overcomes most problems associated with the use of conventional loudspeakers for digital recordings, because all drivers are always activated and all drivers use substantially the same waveform as shown in FIG. 3.

Alternatively, in a second algorithm, a first driver is activated and driven until the signal level reaches a first predetermined level; a second driver is activated when the signal level reaches the first predetermined level; and subsequent drivers are activated as the signal level reaches subsequent respective predetermined levels; whereby all activated drivers share load equally at all activated levels.

Alternatively, in a third algorithm, a first driver is driven until the signal level reaches a first predetermined level, wherein a second driver is activated as the signal level reaches the first predetermined level; wherein subsequent drivers are activated as the signal level reaches subsequent respective predetermined levels; whereby each newly activated driver takes the load required and all other activated drivers are saturated. This algorithm is shown in FIG. 4 for a full level sine wave with 16 drivers.

For Algorithm 1 all drivers are activated at all signal levels. Algorithms 2 and 3 have the advantage that at low signal levels only a single driver is activated, thus potentially giving higher quality sound at such levels than would be the case with algorithm 1. Algorithm 3 has the advantage of only having signal gradient discontinuities at the change over levels—thus reducing unwanted transient switching problems.

Preferably for algorithms 2 and 3, an exponential or other smoothing function is applied to the control signal for each newly activated driver such that the addition of a new driver to all the other activated drivers is achieved in a continuous manner.

Algorithms 2 and 3 can be considered as producing, drive signals with effective time-varying gain. However, rapid changes in the gain associated with each driver can cause undesirable non-linear distortion effects and therefore a still further way of controlling the drivers is to control the rate at which the gain to each driver changes so that is changed in a smooth fashion. Therefore, preferably, a smoothing function is first applied to the master drive signal at the input to the loudspeaker. The smoothed drive signal can then be used to calculate the number of operational drivers required.

A window, such as a sliding boxcar, can be employed successfully in this "smoothing" role. Whereby, the gain applied to each driver is based on the weighted average signal measured as the mean across a number of samples which encompass points both in the future and the past, relative to the current time sample of the master drive signal. Thus, for any time t, the gain is calculated from a weighted mean signal between the times $t-m\Delta t$ and $t+n\Delta t$, where $\Delta t$ is the time between individual signal samples and m and n are integers. These integers may be equal or may be chosen to favour either the past or future portions of the signal. The total duration of the window $(m+n)\ \Delta t$ effectively controls the rate at which the gain to each driver changes. This smoothing box-car function is illustrated in FIG. 5 wherein an initially rapidly changing signal in FIG. 5*a* is smoothed by the action of the box car function into the smooth signal of FIG. 5*b*.

Since the loudest elements of music signals tend to occur at the lowest frequencies, the width of the window can be chosen to properly produce the necessary low frequency signals whilst avoiding rapid changes in gain to each loudspeaker.

Preferably, at very low levels only one driver is activated and at very high levels all drivers are activated, and the sum of all the driver outputs equals the required signal outputs at all times.

At low frequencies the acoustic pressures produced by the action of each active driver will tend to add in a linear fashion. In order to ensure that the combined output from all drivers is correct a control signal can conveniently be applied to the linear time signal to maintain the sum of the linear time output equal to the required signal output.

In contrast, at high frequencies the acoustic pressures produced by the action of each active driver will add in a power manner. Therefore in order to ensure that the combined power output is correct a control signal can conveniently be applied to a suitable squared time signal such that the sum of the acoustic power output is equal to the desired power output. This is beneficial at the higher frequencies where drivers tend to act independently of one another.

Preferably, the controller operates in both linear and power signals, such that at low frequencies the controller maintains the linear sum, whilst at high frequencies the controller maintains the power sum. This arrangement covers a wide frequency range.

DESCRIPTON OF THE FIGURES

Embodiments of the loudspeaker system according to the present invention will now be described with reference to the accompanying drawings in which.

DESCRIPTION OF A PREFERRED EMBODIMENT

Figure 1:
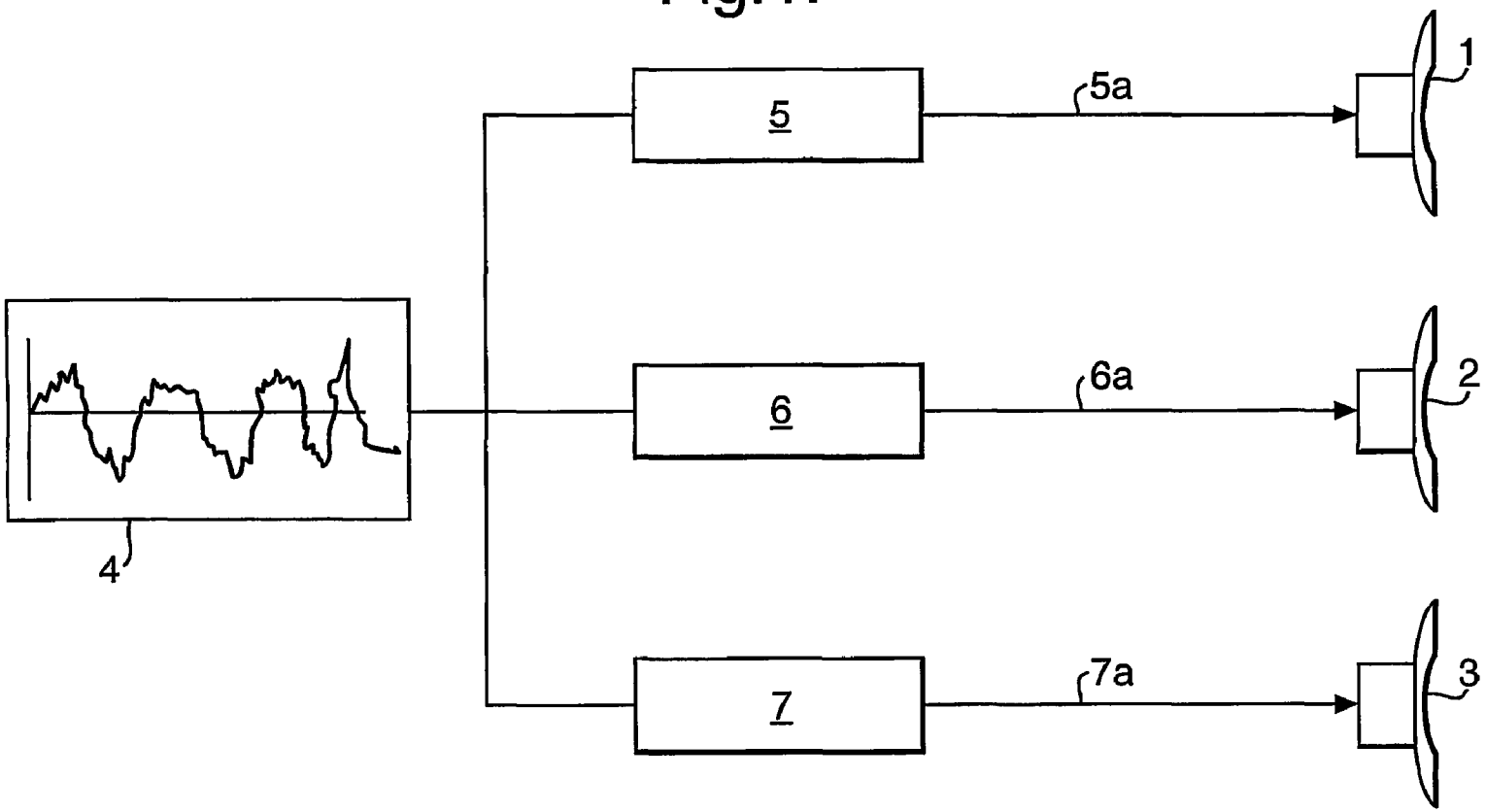
FIG. 1 illustrates a conventional multi-channel loudspeaker system.
Figure 2:
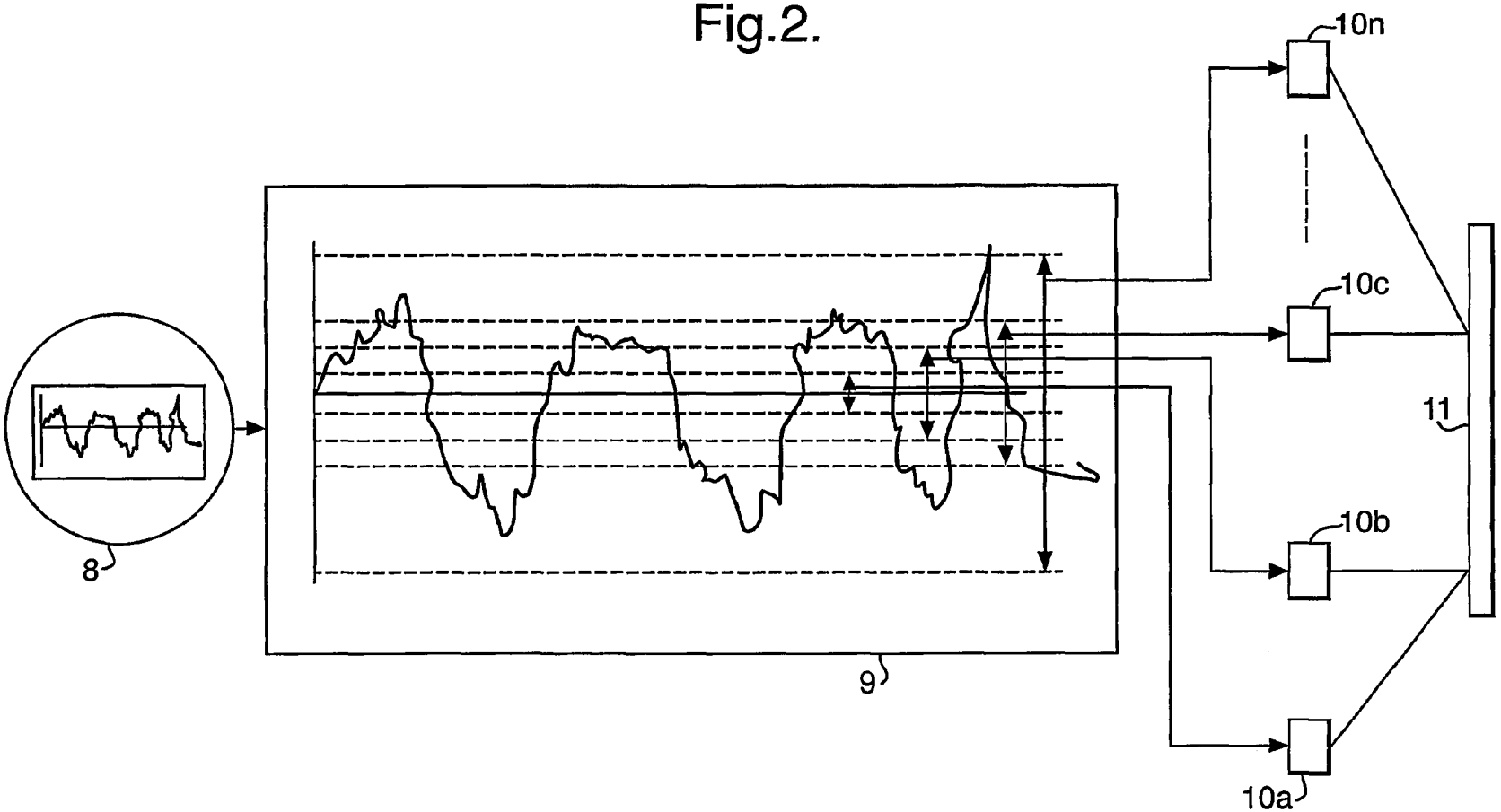
FIG. 2 illustrates a loudspeaker according to the present invention

In one example of a panel form loudspeaker according to the present invention and shown in FIG. 2, a signal 8, for example from an amplifier (not shown) is input to a control processor 9. The output of the control processor 9 modifies the operation of one or more drivers 10 which are mounted adjacent to a radiator panel 11 and when operated excite a multi mode resonance in the panel.

In the present invention, a panel is provided with a plurality of drivers which are arranged across the panel. The arrangement of multiple drivers aims to excite all modes of the panel. This can be achieved using a spiral starting just off centre or an irregular pattern, both spread throughout the panel. Alternatively, drivers may be arranged in a more regular manner, either concentrated at the centre or spread across the panel. This is still effective because the panels themselves tend to be slightly irregular when manufactured.

Figure 6:
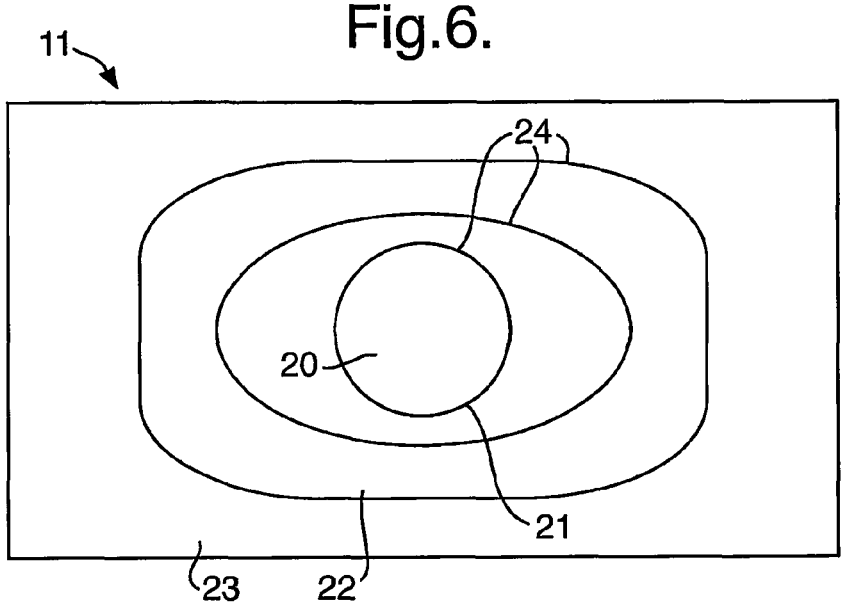
FIG. 6 illustrates one example of a radiator and drivers for a panel-form loudspeaker in accordance with the present invention.

In the example of FIG. 6, a panel 11 is formed of a plurality of sub-panels 20, 21, 22, 23 arranged so that each sub-panel has progressively twice the area of the previous sub-panel moving from the centre outwards (other area ratios may also be suitable). Thus in FIG. 6, the areas of the sub-panels 20, 21, 22, 23 are 1, 2, 4 and 8 units respectively, starting with the centre sub-panel 20 and moving outwards. The combined areas of the sub-panels are thus 1,3,7 and 15 units as the areas are added from the centre outwards. The construction of each sub-panel may be of the same form, or may be different.

The sub-panels are connected one to another at their edges by an acoustically opaque medium 24, such that the mechanical movement of the sub-panels 20, 21, 22, 23 one to another is not impeded, but the connection produces a smooth surface at each junction of the edges.

Figure 7:
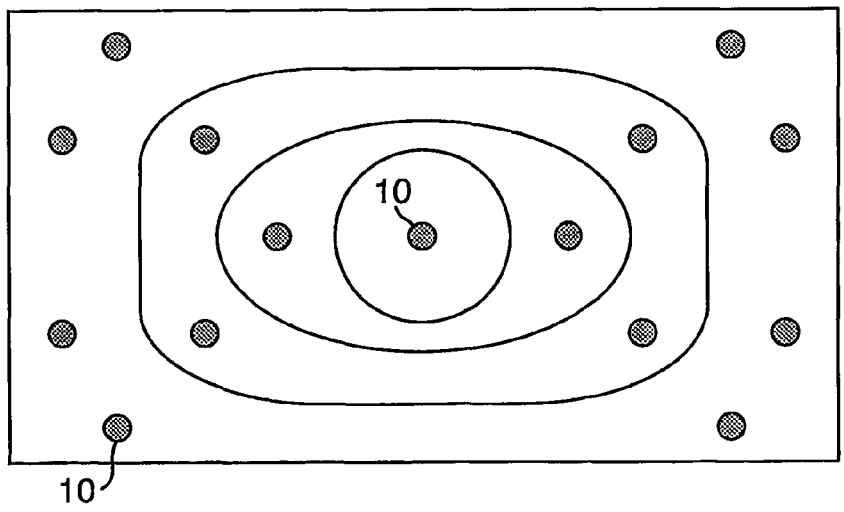
FIG. 7 illustrates another example of a radiator and drivers for a panel form loudspeaker in accordance with the present invention.

The acoustic power produced by each sub-panel is generally proportional to the area of the sub-panel. Each sub-panel will preferably be driven by a different number of identical drivers 10, for example 1,2,4 and 8 respectively moving from the centre outwards. A suitable configuration is shown in FIG. 7, although other configurations may also be used. Smaller numbers of drivers with different power capacities may be used to generate the required power on the sub-panels.

For sub-panels of the same construction, the lowest resonant frequency of the sub-panel depends on its area. Hence, the largest sub-panel will reproduce sound more effectively at low frequencies. Music signals are most usually of a nature such that the highest energy levels rest in the lower frequency range. In one mode of operation, the sub-panels are driven such that at low signal levels or powers only the centre sub-panel 20 is driven and as progressively a higher level or more power is required additional sub-panels 21, 22, 23 are driven to generate the required output level or power. In this example, each driver 10 receives the same drive signal in terms of frequency content, although the signal level or power allocated to each driver is controlled to generate the required level or power. This is determined by the applicable algorithms described below e.g. with respect to FIGS. 3 and 4.

In a second mode of operation, the frequency content of the drive signals to each sub-panel may be altered such that the inner sub-panels, perhaps two in number are driven at mid and high frequencies, the decision on whether to drive one or two sub-panels being made on the power level of the signal; the outer two sub-panels are driven at lower frequencies with the decision on whether to drive one or two sub-panels being made by the overall level or power level of the signal.

The advantages of a substantially concentric configuration of this type include improved imaging of the speaker due to the important mid and high frequency content coming usually from the centre of the speaker and avoiding interference between drivers which are driven at different levels within the same frequency range. For example, in the case in which only the driver on the centre sub-panel is driven, there is no possibility of unwanted interference effects due to drivers which are not driven as they are not physically connected to the same sub-panel. Another advantage is that the higher power sub-panels are able to respond at lower frequencies as would be required by the music.

In another example of the present invention, the radiator may be formed as a series of concentric circles. Other shapes can be used equally well and adjacent areas need not always differ in size by a factor of two.

Figure 3:
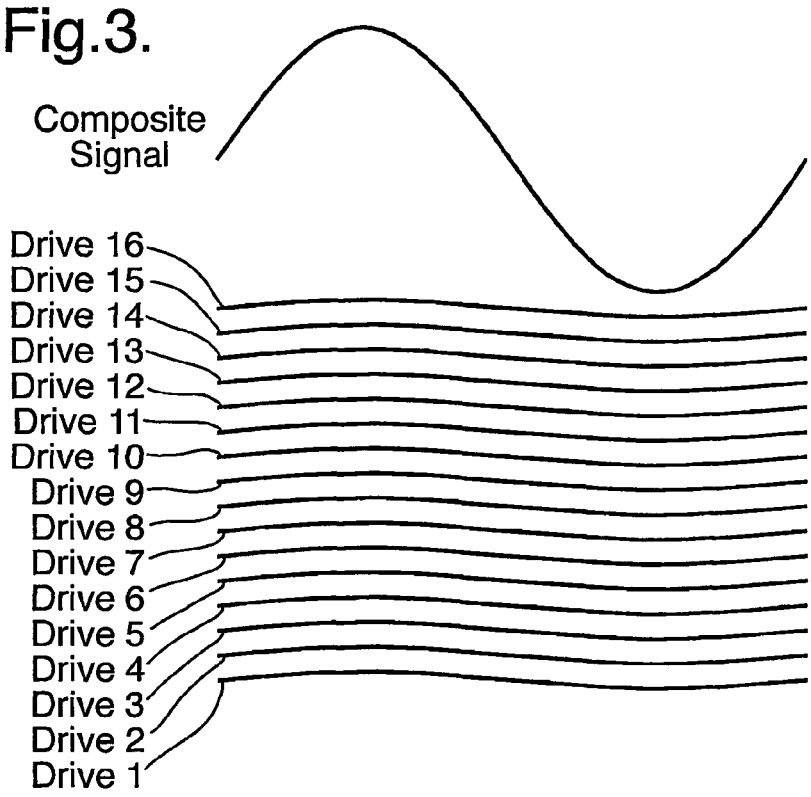
FIG. 3 illustrates an algorithm (=algorithm 1) to control operation of a loudspeaker according to the present invention

In use, the panel-form loudspeaker of the present invention is operated by the control processor comparing the input or base signal with a set of known criteria and then controlling the operation of the drivers in response to this. For example, an oversampling method can be used. The signal to each driver 10 is determined at each digital data point using INT $\{(x+k)/n\}$ for the kth driver, $0 \leqq k < n$, where x is the basic signal level expressed as a signed integer, n is the number of drivers and INT { } implies the lowest integer part of. This algorithm is shown in FIG. 3 for a full level sine wave with 16 drivers. This example has the advantage that all drivers use substantially the same waveform as shown in FIG. 3.

In a second example, one driver 10*a* is always driven and for levels of the base signal, which fall within its dynamic range, this is the only driver activated. When the level of the signal goes above this, another driver 10*b* is switched on such that both now share the load equally (i.e. at changeover the signal to the original driver is halved and this same half signal is sent to the second driver). When the level exceeds that which can be accommodated by two drivers, a further driver 10*c* will be switched on such that all three now share the load equally and so on until all drivers are in use. This particular embodiment can suffer from a problem of significant transients and distortions occurring at changeover, but it has the advantage of being particularly easy to implement.

Figure 4:
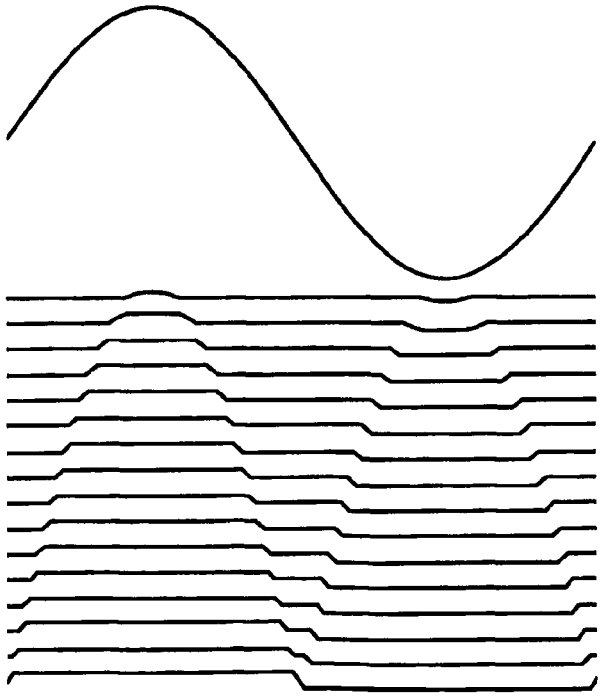
FIG. 4 illustrates an algorithm (=algorithm 3) to control operation of a loudspeaker according to the present invention.

In a third example, one driver 10*a* is always driven and for levels of the base signal which fall within its dynamic range this is the only driver activated. When the level of the signal goes above this, another driver 10*b* is switched on to add to the first driver 10*a*, but the first driver 10*a* is left saturated such that at the changeover the second driver 10*b* is at its minimum level. When the level exceeds that which can be accommodated by two drivers, a further driver 10*c* will be switched on and so on until all drivers are in use. This algorithm is shown in FIG. 4 for a full level sine wave with 16 drivers. This third example has the advantage of only having signal gradient discontinuities at the change over levels—thus reducing unwanted transient switching problems.

Figure 8:
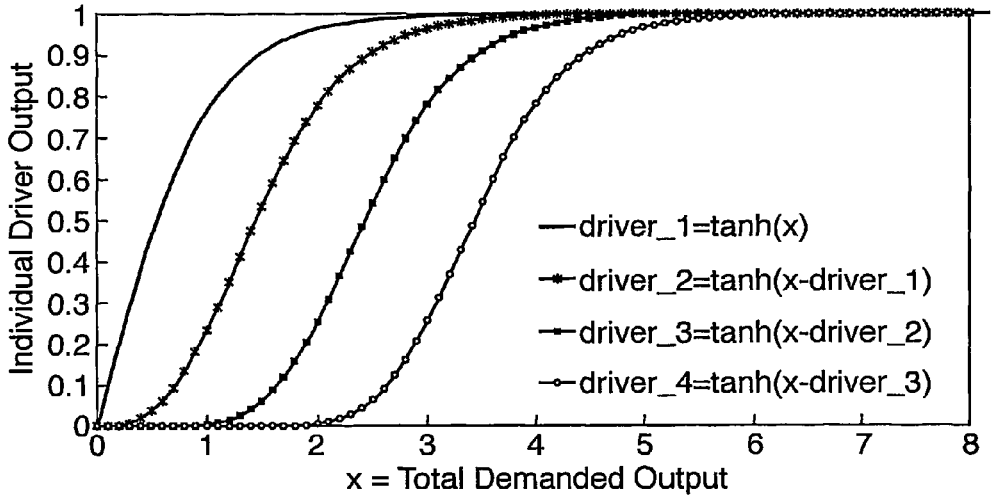
FIGS. 8 and 9 illustrate a suitable smoothing function (for use with algorithm 3) to apply to each driver such that new drivers are brought in smoothly; and Note: throughout all the Figures like numerals are used to denote like features.
Figure 9:
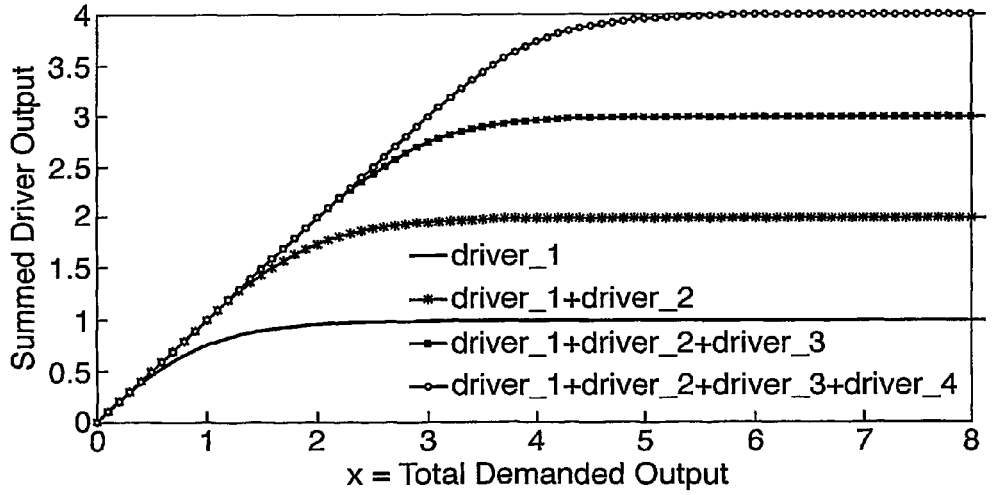

A further improvement is to apply a smoothing function to the control signal applied to each newly activated driver, so that the new driver is brought in in a continuous manner, rather than a step change. An example of a suitable smoothing function is a tanh function as shown in FIG. 8 for four drivers. As a new driver is added, the signals combine smoothly until the total required output level is reached, as illustrated by FIG. 9.

In a fourth example (see FIG. 5) the gain associated with the signal for each driver is smoothed in the time domain using a moving, short duration averaging algorithm. This smoothed amplitude signal is used as the master control to decide the gain of each driver. In essence, each driver receives the original waveform but at a level controlled by the smoothed level of the original waveform.

Figure 5A:
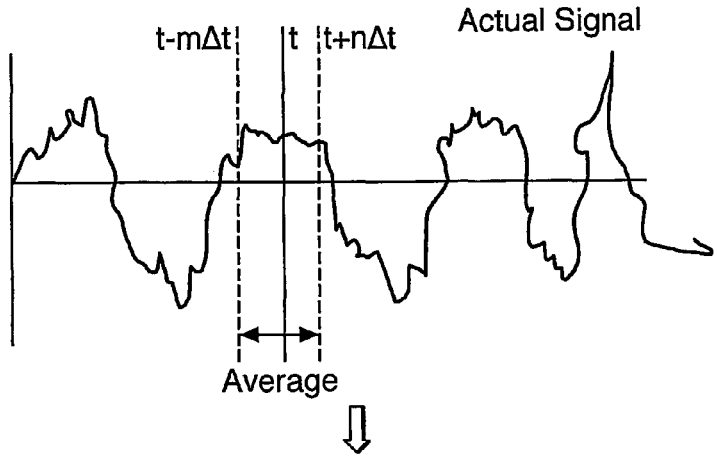
FIG. 5 illustrates the sliding boxcar averaging process to determine the controlling master amplitude, according to the present invention.
Figure 5B:
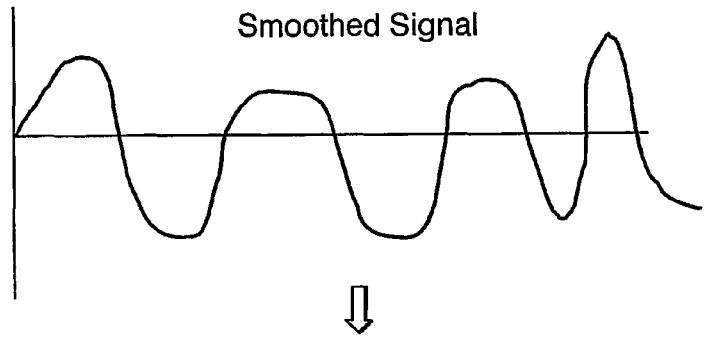
Figure 5C:
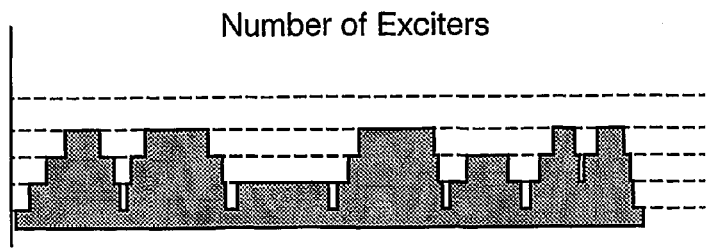

This example is illustrated in FIG. 5. An input signal is depicted in FIG. 5 as having a rapidly changing level. Controlling the drivers based on this drive signal could cause non-linear distortion effects and so a boxcar smoothing function is applied to the signal in order to produce the smooth signal depicted in FIG. 5*b*. This smooth signal can now be used to determine the number of drivers to be used. In this case the aforementioned algorithm 3 is used and subsequent drivers are activated as the signal level reaches subsequent respective predetermined levels (see FIG. 5*c*). An exponential smoothing function has not been applied in this instance.

The type of input signal used by the control processor to control the drivers is dependent on the frequency. At low frequencies, e.g. below 300 Hz, use of linear signals is preferred because the whole panel moves in monophase and at higher frequencies, e.g. greater than 500 Hz, power signals are preferred because multi-modal resonances are excited in the radiator as described in EP0541646. In the crossover region between 300 Hz and 500 Hz, the signals will be partially linear and partially power signals. The invention applies to any size of loudspeaker. However, at the low frequency end there may need to be a minimum size to obtain the benefits of the present invention.

Another feature of the invention is to consider all drivers on each sub-panel as a single driver for the purposes of applying the various control algorithms described above.

The invention claimed is:

1. A panel form loudspeaker comprising a resonant multi-mode radiator; the radiator having a plurality of substantially concentric sub-panels each sub-panel having positioned thereon at least one analogous driver;

a control processor responsive to an input signal, the control processor providing each driver with a drive signal defining an operational state of each driver wherein the operational state of each driver is controlled independently from that of at least one other driver; and wherein the relative operational state of each driver is determined according to an amplitude level of the input signal.

2. A panel form loudspeaker according to claim 1, wherein the sub-panels are coupled together via an acoustically opaque medium.

3. A panel form loudspeaker according to claim 1 wherein each additional sub-panel has an area about twice that of the preceding sub-panel.

4. A panel form loudspeaker according to claim 1 wherere each additional sub-panel has a number of drivers twice that of the preceding sub-panel.

5. A panel form loudspeaker according to claim 1, the loudspeaker comprising at least a first and second driver wherein the first driver is activated and driven until its drive signal level reaches a first predetermined level; wherein the second driver is activated when the drive signal level of the first driver reaches the first predetermined level; and wherein at least one of any subsequent drivers is activated as a previously activated driver reaches its predetermined drive level; whereby all activated drivers share load equally at all activated levels.

6. A panel form loudspeaker according to claim 5 wherein the activation of a subsequent driver is achieved in a continuous manner by applying a smoothing function to the drive signals sent to the drivers.

7. A panel form loudspeaker according to claim 1, the loudspeaker comprising at least a first and a second driver, wherein the first driver is driven until its drive signal level reaches a first predetermined level, wherein the second driver is activated when the drive signal level of the first driver reaches the first predetermined level; wherein at least one of any subsequent drivers is activated as a previously activated driver reaches its predetermined drive levels; whereby each newly activated driver takes the load required and all other activated drivers are saturated.

8. A panel form loudspeaker according to claim 7 wherein the activation of a subsequent driver is achieved in a continuous manner by applying a smoothing function to the drive signals sent to the drivers.

9. A panel form loudspeaker according to claim 1 wherein at very low input signal levels only one driver is activated and at very high input signal levels all drivers are activated and wherein the sum of all the driver outputs equals the required signal outputs at all times.

10. A panel form loudspeaker according to claim 1, wherein the control processor is arranged to provide each driver with a drive signal derived according to the equation:

$$_{Dk}=INT\ \{(x+k)/n\}$$

where:

n is the number of drivers, $D_k$ is the drive signal to the kth driver, $0 \leqq k < n$, INT { } is the lowest integer part of { }, x is the amplitude of the input signal expresses as a signed integer.

11. A panel form loudspeaker according to claim 1 wherein the sum of all drive signals is proportional to the amplitude of the input signal.

12. A panel form loudspeaker according to claim 1 wherein an acoustic power level created by the sum of all drive signals is proportional to the square of the amplitude of the input signal.

13. A panel form loudspeaker according to claim 1 wherein the control processor is arranged to produce a drive signal to each driver wherein, below a predetermined frequency threshold the sum of drive signals below said frequency threshold is proportional to the amplitude of that part of the input signal below said threshold, and above said threshold an acoustic power level created by the sum of all driver signals is proportional to the square of the amplitude of that part of the input signal above said threshold.

* * * * *